US009888718B2

(12) United States Patent
Liu

(10) Patent No.: US 9,888,718 B2
(45) Date of Patent: Feb. 13, 2018

(54) ELECTRONIC CIGARETTE

(71) Applicant: Kimree Hi-Tech Inc., Tortola, Virgin Islands (GB)

(72) Inventor: Qiuming Liu, Guangdong (CN)

(73) Assignee: HUIZHOU KIMREE TECHNOLOGY CO., LTD. SHENZHEN BRANCH, Guangdong (CN)

( * ) Notice: Subject to any disclaimer, the term of this patent is extended or adjusted under 35 U.S.C. 154(b) by 0 days.

(21) Appl. No.: 14/435,636

(22) PCT Filed: Mar. 5, 2014

(86) PCT No.: PCT/CN2014/072919

§ 371 (c)(1),
(2) Date: Apr. 14, 2015

(87) PCT Pub. No.: WO2015/123896

PCT Pub. Date: Aug. 27, 2015

(65) Prior Publication Data

US 2016/0366936 A1 Dec. 22, 2016

(30) Foreign Application Priority Data

Feb. 20, 2014 (CN) ..... 2014 2 0074442 U

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/00; A61M 15/06
See application file for complete search history.

(56) References Cited

U.S. PATENT DOCUMENTS 6,170,490 B1 * 1/2001 Barrow ..... A24F 19/0064 131/235.1
8,375,957 B2 * 2/2013 Hon ..... A24F 47/008 128/202.21

(Continued)

FOREIGN PATENT DOCUMENTS

CN 202456412 U 10/2012
CN 2013152480 U 8/2013

(Continued)

OTHER PUBLICATIONS

International Search Report dated Nov. 19, 2014 corresponding to PCT/CN2014/072919, 7 pp.

(Continued)

*Primary Examiner* — Cynthia Szewczyk
(74) *Attorney, Agent, or Firm* — Ohlandt, Greeley, Ruggiero & Perle, LLP

(57) ABSTRACT

An electronic cigarette is provided. The electronic cigarette includes an electronic cigarette body. The electronic cigarette body includes a suction end, a liquid container for containing cigarette liquid, an atomizing assembly for atomizing the cigarette liquid and a battery rod assembly for supplying power to the atomizing assembly. The atomizing assembly and the battery rod assembly are inserted in the liquid container. The whole structure of the electronic cigarette is compact and the external size of the electronic cigarette is small. The user may not get scalded when the atomizing assembly works or in the case that an excessive discharging is caused due to, for example, a short circuit in the battery rod assembly; and the heat can be rapidly dissipated through the heat absorption of the cigarette liquid in the liquid container in case of the excessive discharging.

16 Claims, 4 Drawing Sheets

(56) References Cited

U.S. PATENT DOCUMENTS

| | | | | |
|---|---|---|---|---|
| 2007/0074734 | A1* | 4/2007 | Braunshteyn | A24F 47/008 131/328 |
| 2012/0167906 | A1 | 7/2012 | Gysland | |
| 2013/0168880 | A1* | 7/2013 | Duke | A24F 47/008 261/78.2 |
| 2013/0284194 | A1 | 10/2013 | Newton | |

FOREIGN PATENT DOCUMENTS

| | | | |
|---|---|---|---|
| CN | 203314099 | U | 12/2013 |
| CN | 203327954 | U | 12/2013 |

OTHER PUBLICATIONS

International Written Opinion dated Nov. 19, 2014 corresponding to PCT/CN2014/072919, 5 pp.

* cited by examiner

ELECTRONIC CIGARETTE

CROSS-REFERENCED APPLICATIONS

The present application is the national phase of International Application No. PCT/CN2014/072919, titled "ELECTYRONIC CIGARETTE", filed on Mar. 5, 2014, which claims the priority to Chinese Patent Application No. 201420074442.6, entitled "ELECTRONIC CIGARETTE", filed on Feb. 20, 2014 with the State Intellectual Property Office of the PRC, which are incorporated herein by reference in their entireties.

BACKGROUND

1. Field of the Disclosure

The application relates to the technical field of electronic cigarette, and in particular, to an electronic cigarette having portability and high security.

2. Discussion of the Background Art

Reference is made to FIG. 1, which shows a detailed structure of a conventional electronic cigarette. According to FIG. 1, the conventional electronic cigarette includes an atomizing assembly and a battery rod assembly. The atomizing assembly is provided with a suction end 100, a liquid storage cotton 110 for storing cigarette liquid, and an electric heating wire assembly 120 for heating up to atomize the cigarette liquid. Two ends of an electric heating wire in the electric heating wire assembly 120 are respectively electrically connected to atomizing electrodes located at an end of the atomizing assembly, and are electrically connected to the battery rod assembly via the atomizing electrode. The battery rod assembly is provided with a battery 130 for supplying power to the electric heating wire assembly 120, and the liquid storage cotton 110 is arranged near the suction end 100. Further, as shown in FIG. 1 inside the electric cigarette, an aerosol passage is formed along the axis of the liquid storage cotton, and the suction end 100 communicates with an air inlet located on the battery rod assembly via the aerosol passage. When the electronic cigarette operates, the cigarette liquid in the liquid storage cotton 110 is atomized by the atomizing assembly, and the aerosol generated after atomization flows through the aerosol passage and is further inhaled by a user through the suction end 100.

However conventionally, both the atomizing assembly and the battery rod assembly are exposed outside the electronic cigarette. Therefore, the user is apt to be scalded when the atomizing assembly works or in the case that an excessive discharging is caused due to, for example, a short circuit in the battery rod assembly, which results in poor user experience. In addition, if excessive discharging is caused due to, for example, the short circuit in the battery rod assembly and heat can not be dissipated rapidly, potential safety hazard exists.

SUMMARY

In view of this, a portable electronic cigarette is provided in the present application.

An electronic cigarette includes:

an electronic cigarette body;

where the electronic cigarette body includes a suction end, a liquid container for containing a cigarette liquid, an atomizing assembly for atomizing the cigarette liquid, and a battery rod assembly for supplying power to the atomizing assembly; and the atomizing assembly and the battery rod assembly are inserted in the liquid container.

The electronic cigarette further includes:

a connector;

where one end of the connector is arranged as the suction end; and the other end of the connector is detachablely connected with the liquid container;

where a first connecting part and a second connecting part are provided in the connector;

the battery rod assembly is detachablely connected to the connector via the first connecting part; and the atomizing assembly is detachablely connected to the connector via the second connecting part.

In the electronic cigarette, the first connecting part and the second connecting part are arranged parallelly, and the atomizing assembly and the battery rod assembly are parallelly arranged in the liquid container.

In the electronic cigarette, a first electrode for electrically connecting with a battery electrode of the battery rod assembly is provided in the first connecting part;

a first insulation ring is provided between the first connecting part and the first electrode;

a second electrode for electrically connecting with an atomizing electrode of the atomizing assembly is provided in the second connecting part;

a second insulation ring is provided between the second connecting part and the second electrode; and the first electrode and the second electrode are electrically connected.

In the electronic cigarette, the suction end is formed by an extension of an end portion of the connector; or the suction end is detachablely connected with the connector.

In the electronic cigarette, an accommodating part for accommodating the atomizing assembly is provided in the battery rod assembly;

the atomizing assembly is arranged inside the accommodating part; and a third connecting part configured to be detachablely connected with the atomizing assembly is provided at an end portion of the battery rod assembly, the end portion of the battery rod assembly being connected with the atomizing assembly.

In the electronic cigarette, a third electrode and a fourth electrode for electrically connecting with atomizing electrodes of the atomizing assembly are provided in the third connecting part;

the third electrode and the fourth electrode are electrically connected with battery electrodes of the battery rod assembly; and a third insulation ring is provided between the third electrode and the fourth electrode.

In the electronic cigarette, the liquid container which accommodates the battery rod assembly is detachablely connected with the suction end; and the battery rod assembly and the suction end are detachablely connected; or the suction end is formed by an extension of an end portion of the battery rod assembly.

In the electronic cigarette, a sealing ring for sealing the liquid container is provided at a position where the connector connects with the liquid container.

In the electronic cigarette, at least one air inlet which communicates with the suction end and is isolated from the liquid container is provided on the electronic cigarette body.

In the electronic cigarette, the liquid container and the connector are detachablely connected via a screw thread or a rotatable snap;

the battery rod assembly and the first connecting part are detachablely connected via a screw thread or a rotatable snap; and the atomizing assembly and the second connecting part are detachablely connected via a screw thread or a rotatable snap.

In the electronic cigarette, the suction end and the connector are detachablely connected via a screw thread or a rotatable snap.

In the electronic cigarette, the liquid container and the suction end are detachablely connected via a screw thread or a rotatable snap; and the battery rod assembly and the suction end are detachablely connected via a screw thread or a rotatable snap.

In the electronic cigarette, a sealing gasket for sealing the liquid container is provided at a position where the connector connects with the liquid container.

In the electronic cigarette, the liquid container is a transparent container.

In the electronic cigarette, the liquid container is a glass bottle.

In the electronic cigarette, the liquid container is coated by a protective cartridge and the protective cartridge is provided with a cigarette liquid observation window.

According to the technical solution described above, the electronic cigarette provided in the present application includes the electronic cigarette body; the electronic cigarette body is provided with the suction end, the liquid container for containing the cigarette liquid, the atomizing assembly for atomizing the cigarette liquid and the battery rod assembly for supplying power to the atomizing assembly; the atomizing assembly and the battery rod assembly are inserted in the liquid container. The battery rod assembly and the atomizing assembly of the electronic cigarette provided in the application are inserted in the liquid container, such that the whole structure of the electronic cigarette is compact and the external size of the electronic cigarette is small, which is convenient for the user to carry the electronic cigarette. In addition, since the battery rod assembly and the atomizing assembly are inserted in the liquid container, the user may not get scalded when the atomizing assembly works or in the case that an excessive discharging is caused due to, for example, a short circuit in the battery rod assembly, therefore increasing the user experience. Furthermore, the heat can be rapidly dissipated through the heat absorption of the cigarette liquid in the liquid container in the case that the excessive discharging is caused due to, for example, a short circuit in the battery rod assembly located inside the liquid container, therefore avoiding potential safety hazard and improving the security.

BRIEF DESCRIPTION OF THE DRAWINGS

For more clearly illustrating technical solution of embodiments of the present application or the conventional technologies, drawings to be used in descriptions of the embodiments or the conventional technologies are briefly introduced below. Apparently, the drawings are used to illustrate only some embodiments of the present application, and those of ordinary skill in the art may obtain other drawings, based on these drawings, without any creative efforts.

DETAILED DESCRIPTION OF THE PREFERRED EMBODIMENT

Figure 1:
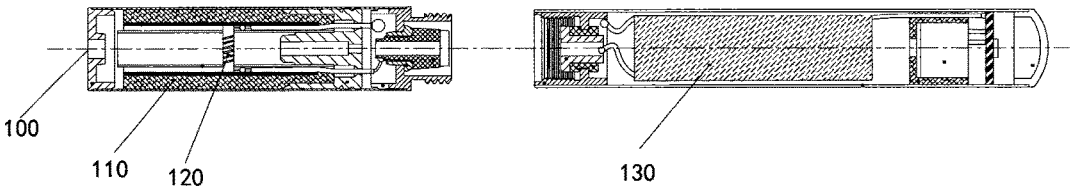
FIG. 1 is a schematic sectional view showing the whole structure of a conventional electronic cigarette.
Figure 2:
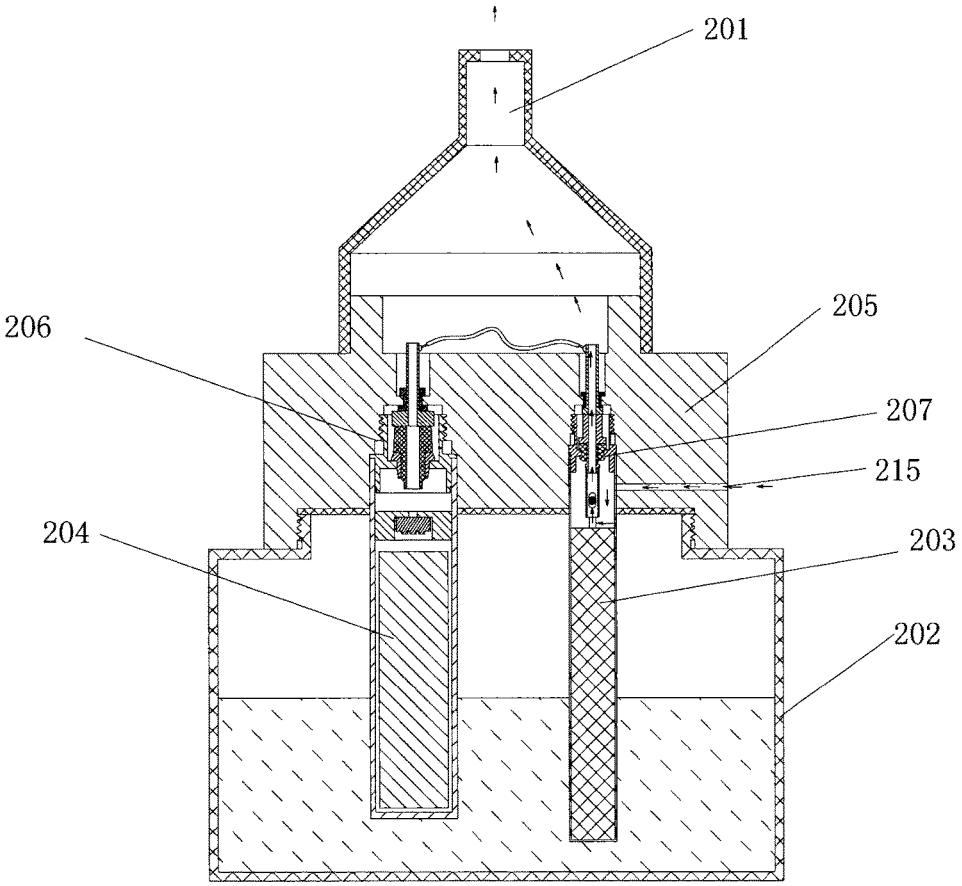
FIG. 2 is a schematic sectional view showing a whole electronic cigarette according to a preferred embodiment of the present application.

The present application discloses a portable electronic cigarette, and the structure of the electronic cigarette is shown in FIG. 2.

The electronic cigarette includes an electronic cigarette body.

A suction end 201 is arranged on a top end of the electronic cigarette body. A user may smoke through the suction end 201.

A liquid container 202 is provided to store a cigarette liquid, that is, an atomizable cigarette liquid is stored in the liquid container 202.

An atomizing assembly 203 is provided to atomize the cigarette liquid, that is, the cigarette liquid in the liquid container 202 can be atomized by the atomizing assembly 203.

The electronic cigarette further includes a battery rod assembly 204 which supplies power to the atomizing assembly 203.

To prevent the user from getting scalded by the electronic cigarette provided in the present application when the atomizing assembly 203 works or in the case that an excessive discharging is caused due to, for example, a short circuit in the battery rod assembly 204, and to avoid potential safety hazard in the case that an excessive discharging is caused due to, for example, a short circuit in the battery rod assembly 204, the atomizing assembly 203 and the battery rod assembly 204 are inserted in the liquid container 202.

Since the atomizing assembly 203 and the battery rod assembly 204 are accommodated in the liquid container 202 of the electronic cigarette according to the embodiment, heat dissipated from the atomizing assembly 203 and the battery rod assembly 204 can be dissipated out via the liquid container 202, thereby avoiding potential safety hazard due to poor heat dissipation of the electronic cigarette. In addition, since the atomizing assembly 203 and the battery rod assembly 204 are not exposed outside the electronic cigarette body, the user may not directly touch the atomizing assembly 203 and the battery rod assembly 204, thereby effectively preventing the user from getting scalded.

The atomizing assembly 203 and the battery rod assembly 204 are parallelly arranged in the liquid container 202. Consequently, the electronic cigarette has a compact structure and an external size smaller than that of a conventional electronic cigarette in which the atomizing assembly and the battery rod assembly are arranged coaxially, and is convenient for the user to carry.

The specific structure of the electronic cigarette provided in the present application is further detailed hereinafter in conjunction with FIG. 2. According to an embodiment shown in FIG. 2, the electronic cigarette further includes a connector 205.

The suction end 201 is arranged on one end of the connector 205.

The suction end 201 is formed by extending one end of the connector 205, that is, the suction end 201 and the connector 205 are arranged integratedly. Or, the suction end 201 and the connector 205 are detachablely connected, such that the user can replace the suction end 201 at any time.

The suction end 201 and the connector 205 are detachablely connected via a screw thread or a rotatable snap. A specific connecting structure is not limited in the embodiment, as long as the suction end 201 and the connector 205 are detachablely connected.

The other end of the connector 205 and the liquid container 202 are detachablely connected, and the user can replace the liquid container 202 or add cigarette liquid into the liquid container 202 based on needs at any time.

Specifically, the liquid container 202 and the connector 205 are detachablely connected via a screw thread or a rotatable snap. A specific structure for connecting the liquid container 202 and the connector 205 is not limited in the embodiment, as long as the liquid container 202 and the connector 205 are detachablely connected.

A first connecting part 206 and a second connecting part 207 are provided in the connector 205.

Figure 3:
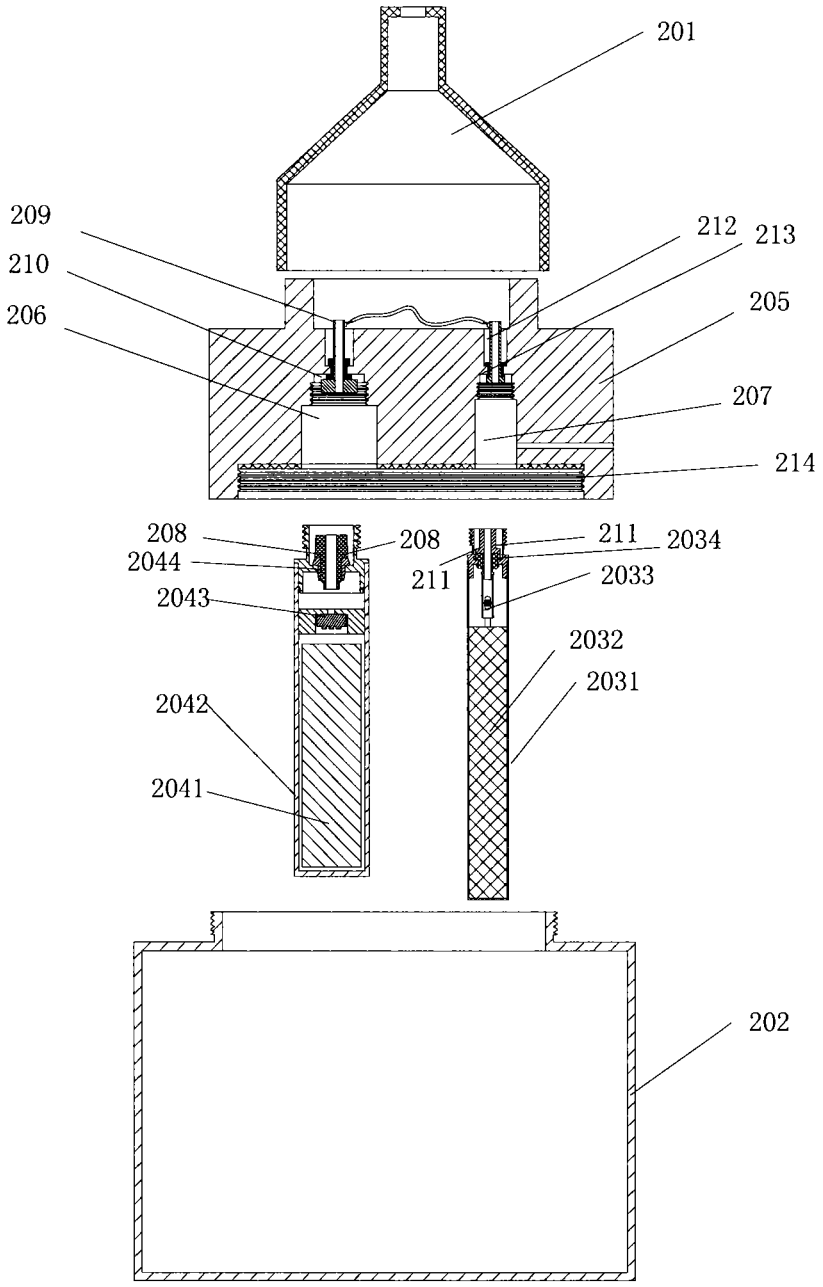
FIG. 3 is an exploded structural view of the electronic cigarette provided in the present application as shown in FIG. 2.

A specific structure of the connector 205 is shown in FIG. 3.

As shown in FIG. 3, the battery rod assembly 204 in the liquid container 202 is detachablely connected with the connector 205 via the first connecting part 206.

The atomizing assembly 203 in the liquid container 202 is detachablely connected with the connector 205 via the second connecting part 207.

Since the battery rod assembly 204 and the connector 205 are detachablely connected via the first connecting part 206, the user can detach the battery rod assembly 204 based on needs at any time.

Since the atomizing assembly 203 and the connector 205 are detachablely connected via the second connecting part 207, the user can detach the atomizing assembly 203 based on needs at any time.

Further, with reference to FIGS. 2 and 3, the first connecting part 206 and the second connecting part 207 are parallelly arranged, such that the atomizing assembly 203 and the battery rod assembly 204 are parallelly arranged in the liquid container 202.

Of course, it is merely an example that the atomizing assembly 203 and the battery rod assembly 204 are parallelly arranged in the liquid container 202 in the embodiment. Alternatively, one of the atomizing assembly 203 and the battery rod assembly 204 locates higher while the other locates lower, or the atomizing assembly 203 and the battery rod assembly 204 are arranged coaxially. A specific arranging manner is not limited herein as long as the atomizing assembly 203 and the battery rod assembly 204 are inserted inside the liquid container 202.

Reference is further made to FIG. 3, how the battery rod assembly 204 and the atomizing assembly 203 are connected to the connector 205 is described in detail hereinafter. To make the structure of the electronic cigarette body simpler and more compact to facilitate assembling and increasing production efficiency, the connector 205 is made of a conductive material, preferably made of a metallic material, such that an electric connection between one atomizing electrode in the atomizing assembly 203 and one battery rod electrode 208 in the battery rod assembly 204 is directly achieved through the connector 205.

As shown in FIG. 3, a first electrode 209 to be electrically connected with one battery rod electrode 208 of two battery rod electrodes 208 of the battery rod assembly 204 is provided in the first connecting part 206. The battery rod electrodes 208 are electrically connected with battery electrodes in the battery rod assembly 204, such that an electric connection between the first electrode 209 and one battery electrode is realized.

A first insulation ring 210 is provided between the first connecting part 206 and the first electrode 209.

The battery rod assembly 204 and the first connecting part 206 are detachablely connected via a screw thread or a rotatable snap. In an embodiment, the battery rod assembly 204 is connected with the connector 205 via another battery rod electrode provided with an external thread, thereby achieving a connection between the connector 205 and one battery electrode.

The battery rod assembly 204 further includes:

a battery 2041;

a battery protective cartridge 2042 for accommodating and protecting the battery 2041;

an airflow sensor 2043 for sensing a suction performed by the user; and a microcontroller electrically connected with the airflow sensor 2043, where in the case that the airflow sensor senses a suction performed by the user, the microcontroller controls an electric heating wire 2033 of the atomizing assembly 203 to atomize the cigarette liquid, to generate aerosol to be inhaled by the user.

A battery rod electrode insulation ring 2044 is arranged around one battery rod electrode 208 which is located at a central portion, to isolate two battery rod electrodes 208 from each other.

In the embodiment, the battery rod assembly 204 and the first connecting part 206 may be connected via other connecting structures and the specific connecting structures are not limited in the embodiment.

A second electrode 212 to be electrically connected with one atomizing electrode 211 of two atomizing electrodes 211 in the atomizing assembly 203 is provided in the second connecting part 207.

A second insulation ring 213 is provided between the second connecting part 207 and the second electrode 212.

The first electrode 209 and the second electrode 212 are electrically connected.

The atomizing assembly 203 further includes:

an electric heating wire 2033 for atomizing the cigarette liquid, where one end of the electric heating wire 2033 is electrically connected to the second electrode 212 via one atomizing electrode 211, and the other end of the electric heating wire 2033 is electrically connected to the connector 205 via the other atomizing electrode 211;

an atomizing cartridge 2031, where a liquid guiding through hole for conveying the cigarette liquid, and the cigarette liquid in the liquid container 202 can be guided into the atomizing cartridge 2031 via the liquid guiding through hole;

a liquid guiding cotton 2032, which is arranged inside the atomizing cartridge 2031 and is for conveying the cigarette liquid to the electric heating wire 2033; and an atomizing electrode insulation ring 2034, which is arranged around the atomizing electrode 211.

Preferably, the battery rod assembly 203 and the second connecting part 207 are detachablely connected via a screw thread or a rotatable snap. A specific connecting structure is not limited in the embodiment as long as the battery rod assembly 203 and the second connecting part 207 are detachablely connected.

In order to prevent a leakage of the cigarette liquid in the liquid container 202, a sealing gasket 214 for sealing the liquid container 202 is provided at a position where the connector 205 connects with the liquid container 202.

To enable the user to acquire the volume of the cigarette liquid remained in the liquid container 202, the liquid container 202 is a transparent container, so that the user can acquire, with the transparent liquid container 202, the volume of the remained cigarette liquid in the electronic cigarette at any time and may replace the liquid container 202 timely and conveniently.

Preferably, the liquid container 202 is a glass bottle. Since glass has a steady property, the smell of the cigarette liquid is prevented from getting affected due to, for example, a chemical reaction.

Preferably, a scale is provided on an outer circumferential wall of the liquid container 202 made of glass, such that the user can estimate an available time duration to inhale with the remained cigarette liquid, which is convenient for usage.

Preferably, the liquid container 202 is provided with a protective cartridge (not shown in the figure) to prevent the liquid container 202 made of glass from getting broken due to falling down.

Preferably, the protective cartridge is provided with a cigarette liquid observation window for observing the cigarette liquid by the user.

According to the embodiment, the battery rod assembly 204 and the atomizing assembly 203 are inserted in the liquid container 202, such that the whole structure of the electronic cigarette is compact and the external size of the electronic cigarette is small, which is convenient for the user to carry the electronic cigarette. Since the battery rod assembly 204 and the atomizing assembly 203 are inserted in the liquid container 202, the user may not get scalded when the atomizing assembly 203 works or in the case that an excessive discharging is caused due to, for example, a short circuit occurs in the battery rod assembly 204, therefore increasing the user experience. Furthermore, the heat can be rapidly dissipated through the heat absorption of the cigarette liquid in the liquid container in the case that the excessive discharging is caused due to, for example, a short circuit in the battery rod assembly 204 located inside the liquid container 202, therefore avoiding potential safety hazard and improving the security.

An airflow passage in the electronic cigarette provided in the present application is described in detail hereinafter in conjunction with FIG. 2.

The electronic cigarette body is provided with at least one air inlet 215 which communicates with the suction end 201 and is isolated from the liquid container 202.

An airflow passage for communicating the suction end 201 and the air inlet 215 is formed in the electronic cigarette body. The airflow passage in the electronic cigarette is shown in FIG. 2.

The user sucks at the suction end 201; after the atomizing assembly 203 senses a suction performed by the user, the electric heating wire 2033 of the atomizing assembly 203 is controlled to atomize the cigarette liquid stored in the liquid container 202 to generate an aerosol, and the aerosol generated through atomization flows to the suction end 201 via the airflow passage, where a specific flowing direction is indicated by arrows in FIG. 2; with the aerosol flowing in the airflow passage, the user may inhale the atomized cigarette liquid.

It should be noted that, the specific number of the air inlet 215 is not limited in the embodiment, as long as the air inlet 215 in communication with the airflow passage is isolated from the liquid container 202, that is, the airflow passage through which the aerosol flows is isolated from the liquid container 202. Hence, the aerosol generated through the atomization performed by the electric heating wire 2033 may not pass a storage area of the cigarette liquid during flowing in the airflow passage.

Since the aerosol generated through the atomization may not pass the storage area of the cigarette liquid in the embodiment, the cigarette liquid which is not atomized may not be conveyed to the suction end 201 and may not be inhaled by the user.

In addition, since the aerosol generated through the atomization may not pass the storage area of the cigarette liquid, the aerosol generated through the atomization may not get condensed due to a heat absorption of the cigarette liquid and may not affect electronic elements in the battery rod assembly 204 and the atomizing assembly 203, which effectively ensures the lifetime of the electronic cigarette.

Another structure of the electronic cigarette provided in the present application is described in detail hereinafter in conjunction with an embodiment shown in FIG. 4. In the embodiment, there is no need to arrange a connector between a liquid container and a suction end, which can be seen with reference to FIG. 4.

Figure 4:
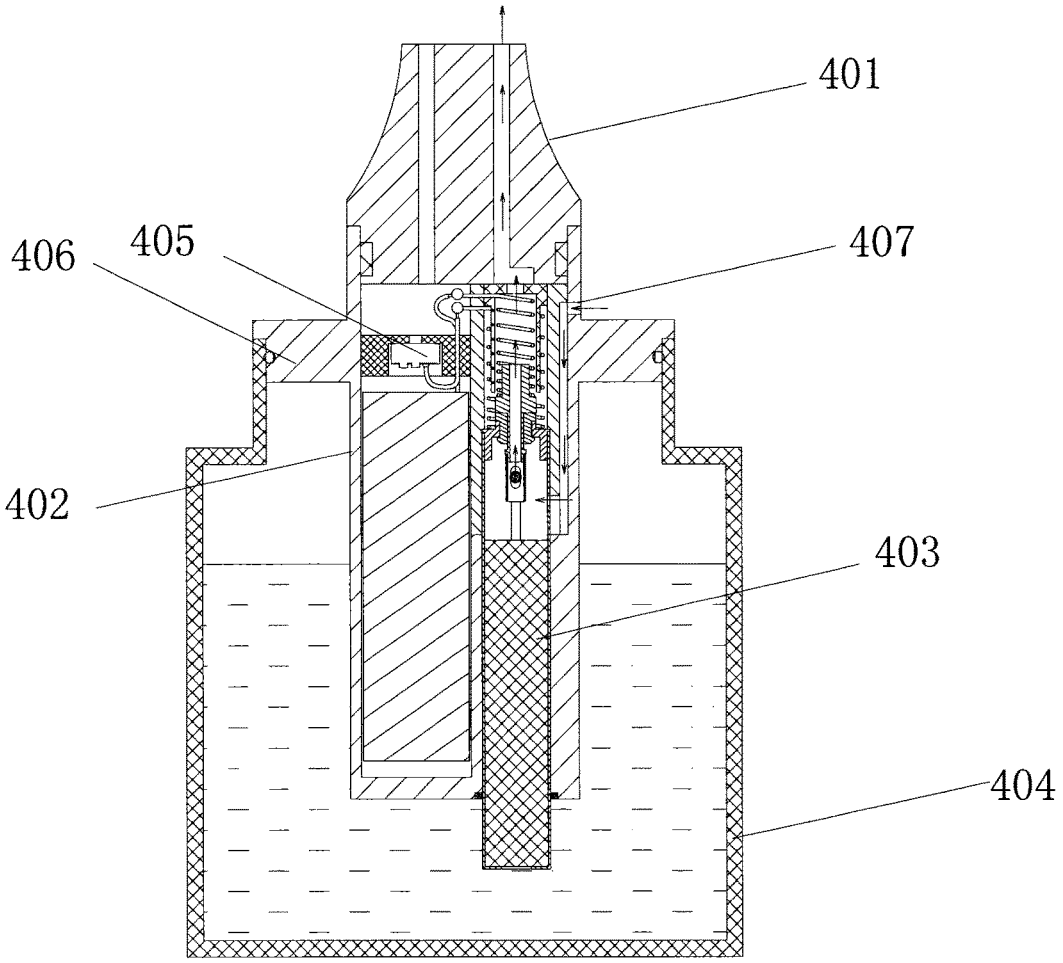
FIG. 4 is a schematic sectional view showing a whole electronic cigarette according to another preferred embodiment of the present application.

An electronic cigarette shown in FIG. 4 includes:

an electronic cigarette body.

The electronic cigarette body is provided with a suction end 401, a liquid container 404 for containing a cigarette liquid, an atomizing assembly 403 for atomizing the cigarette liquid, and a battery rod assembly 402 for supplying power to the atomizing assembly 403.

The liquid container 404 for accommodating the battery rod assembly 402 is detachablely connected with the suction end 401. The suction end 401 and the liquid container 404 are detachablely connected via a screw thread or a rotatable snap.

The battery rod assembly 402 and the suction end 401 are detachablely connected. Or, the suction end 401 is formed by an extension of an end portion of the battery rod assembly 402, that is, the battery rod assembly 402 and the suction end 401 are arranged to be integrated.

The atomizing assembly 403 and the battery rod assembly 402 are inserted in the liquid container 404.

Specifically, the atomizing assembly 403 is inserted in the battery rod assembly 402.

Figure 5:
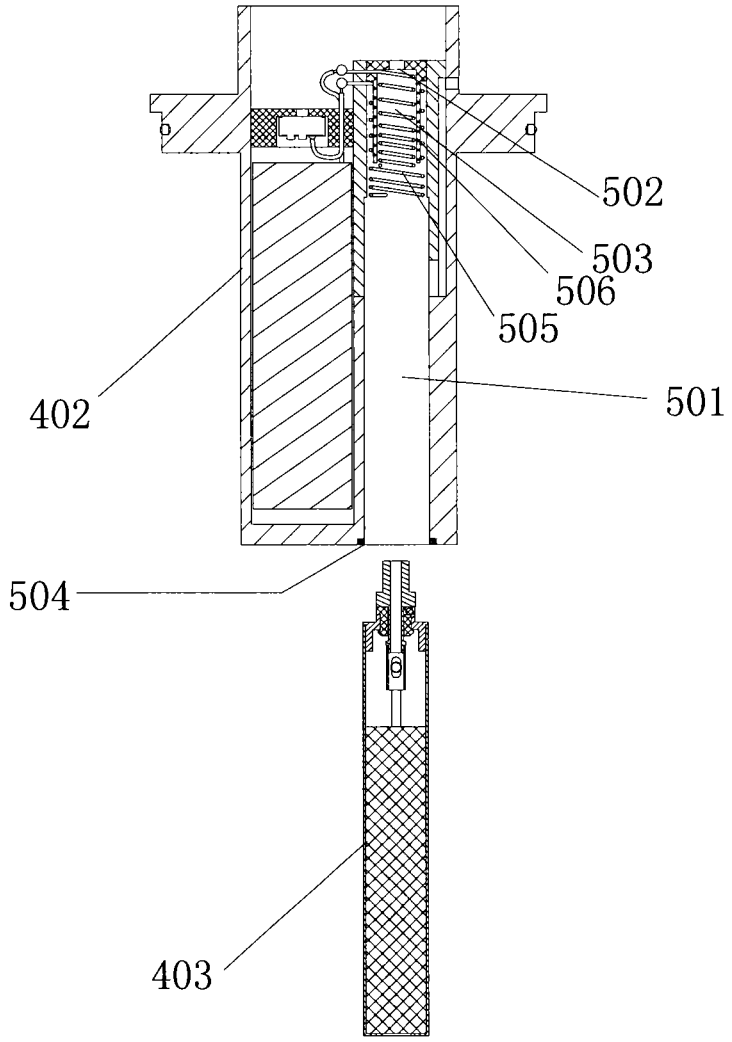
FIG. 5 is an exploded structural view of the electronic cigarette provided in the present application as shown in FIG. 4.

A specific arranging manner is shown in FIG. 5.

A specific structure of battery rod assembly 402 in which the atomizing assembly 403 is inserted is described in detail in conjunction with FIG. 5.

An accommodating part 501 for accommodating the atomizing assembly 403 is provided in the battery rod assembly 402.

The atomizing assembly 403 is arranged inside the accommodating part 501.

A third connecting part 502 used to be detachablely connected with the atomizing assembly 403 is provided at an end portion of the battery rod assembly 402, where the end portion connects with the atomizing assembly 403.

The atomizing assembly 403 is detachablely connected to the battery rod assembly 402 via the third connecting part 502. The whole connecting structure is shown in FIG. 4.

Specifically, a third electrode 503 and a fourth electrode 504 to be electrically connected with the atomizing electrodes of the atomizing assembly 403 are provided in the third connecting part 502. Preferably, the third electrode 503 and the fourth electrode 504 may be spring electrodes, thereby increasing the performance of electrical contact.

Specifically, the fourth electrode 505 is sleeved on the third electrode 503, or the third electrode 503 is sleeved on the fourth electrode 505.

The third electrode 503 and the fourth electrode 505 are electrically connected with the battery rod electrode 405 of the battery rod assembly 402, that is, the third electrode 503 and the fourth electrode 505 are respectively electrically connected to battery electrodes on two ends of a battery in the battery rod assembly 402, that is, the third electrode 503 and the fourth electrode 505 are electrically connected to the anode and the cathode of the battery respectively.

A third insulation ring 506 is provided between the third electrode 503 and the fourth electrode 505.

As shown in FIG. 4, a sealing ring 406 for sealing the liquid container 404 is provided at a position where the liquid container 404 connects with the suction end 401. With the sealing ring 406, the cigarette liquid in the liquid container 404 is prevented from leaking out.

As shown in FIG. 5, a small sealing ring 504 is arranged at a place where the bottom of the accommodating part 501 abuts against the atomizing assembly 403. The atomizing assembly 403 is sealed by the small sealing ring 504.

Preferably, to enable the user to replace the liquid container 404 of the electronic cigarette based on needs at any time, the liquid container 404 and the suction end 401 are detachablely connected via a screw thread or a rotatable snap. Of course, other connecting manners may be employed and the specific connecting manner is not limited in the embodiment.

To enable the user to replace or charge the battery rod assembly 402 based on needs at any time, the battery rod assembly 402 and the suction end 401 are detachablely connected via a screw thread or a rotatable snap. Of course, other connecting manners may be employed and the specific connecting manner is not limited in the embodiment.

References can be made to the above embodiments to understand specific structures of the battery rod assembly 402 and the atomizing assembly 403, which are not described in the embodiment.

Preferably, an airflow passage in the electronic cigarette provided in the present application is described in detail in conjunction with FIG. 4.

The electronic cigarette body is provided with at least one air inlet 407 which communicates with the suction end 401 and is isolated from the liquid container 404.

The airflow passage for communicating the suction end 401 and the air inlet 407 is formed in the electronic cigarette body. The user sucks at the suction end 401; after the atomizing assembly 403 senses a suction performed by the user, the electric heating wire of the atomizing assembly 403 is controlled to atomize the cigarette liquid stored in the liquid container 404 to generate an aerosol, and the aerosol generated through atomization flows to the suction end 401 via the airflow passage, where a specific flowing direction is indicated by arrows in FIG. 4; with the aerosol flowing in the airflow passage, the user may inhale the atomized cigarette liquid.

It should be noted that, the specific number of the air inlet 407 is not limited in the embodiment, as long as the air inlet 407 in communication with the airflow passage is isolated from the liquid container 404, that is, the airflow passage through which the aerosol flows is isolated from the liquid container 404. Hence, the aerosol generated through the atomization performed by the electric heating wire may not pass the liquid container 404 during flowing in the airflow passage.

Since the aerosol generated through the atomization may not pass the liquid container 404 in the embodiment, the cigarette liquid which is not atomized may not be conveyed to the suction end 401 and may not be inhaled by the user.

In addition, since the aerosol generated through the atomization may not pass a storage area of the cigarette liquid, the aerosol generated through the atomization may not get condensed due to a heat absorption of the cigarette liquid and may not affect electronic elements in the battery rod assembly 402 and the atomizing assembly 403, which effectively ensures the lifetime of the electronic cigarette.

Preferably, the airflow passages shown in FIGS. 2 and 4 may not be provided purposely, and the aerosol generated by the electric heating wire flows to the suction end through space between electronic elements in the electronic cigarette. In this way, the assembling efficiency may be increased and the assembling is simplified.

Of course, to ensure a long lifetime for the electronic cigarette and to prevent functions of the electronic elements in the electronic cigarette from getting affected by the aerosol, the airflow passages are arranged to be isolated from both the battery rod assembly and the atomizing assembly.

Specific arranging manners for the airflow passages are not limited in the present application.

Furthermore, it is merely an example that the battery rod assembly provided in the present application senses a suction performed by the user through an airflow sensing switch. A specific way of sensing the suction performed by the user to control the electric heating wire to atomize the cigarette liquid is not limited herein. For example, a button switch may be arranged on the electronic cigarette, and the user may press the button switch to automatically control the electric heating wire to atomize the cigarette liquid, while the user does not need to suck at the suction end.

The technical solutions in the embodiments of the present application are described clearly and completely hereinafter in conjunction with the drawings in the embodiments of the present application. Apparently, the described embodiments are only a part of but not all of the embodiments of the present application. Based on the embodiments in the present application, all of other embodiments made by the person skilled in the art without any creative efforts fall into the protection scope of the present application, for example, the microcontroller is connected with a loudspeaker which is controlled by the microcontroller to make a sound of water during smoking to simulate a hookah, or the atomizing assembly and the battery rod assembly are arranged to be in other structures and of other shapes.

The embodiments in the specification are described in a progressive way, each of which emphasizes on the differences from the other ones, and among which the identical or similar parts can be referred to each other.

Based on the above description of the embodiments, the person skilled in the art is capable of carrying out or using the present application. It is obvious for the person skilled in the art to make many modifications to these embodiments. The general principle defined herein may be implemented in other embodiments without departing from the spirit or scope of the present application. Therefore, the present application is not limited to the embodiments illustrated herein, but should be defined by the broadest scope consistent with the principle and novel features disclosed herein.

The invention claimed is:

1. An electronic cigarette, comprising:

an electronic cigarette body;

wherein the electronic cigarette body comprises a suction end, a liquid container for containing a cigarette liquid, an atomizing assembly for atomizing the cigarette liquid, and a battery rod assembly for supplying power to the atomizing assembly; and the atomizing assembly and the battery rod assembly are inserted in the liquid containers; and wherein, the electronic cigarette further comprises a connector;

wherein one end of the connector is arranged as the suction end; and the other end of the connector is detachablely connected with the liquid container;

wherein a first connecting part and a second connecting part are provided in the connector;

the battery rod assembly is detachablely connected to the connector via the first connecting part; and the atomizing assembly is detachablely connected to the connector via the second connecting part; and wherein the first connecting part and the second connecting part are arranged parallelly, and the the atomizing assembly and the battery rod assembly are parallelly arranged in the liquid container.

2. The electronic cigarette according to claim 1, wherein a first electrode for electrically connecting with a battery electrode of the battery rod assembly is provided in the first connecting part;

a first insulation ring is provided between the first connecting part and the first electrode;

a second electrode for electrically connecting with an atomizing electrode of the atomizing assembly is provided in the second connecting part;

a second insulation ring is provided between the second connecting part and the second electrode; and the first electrode and the second electrode are electrically connected.

3. The electronic cigarette according to claim 1, wherein the suction end is formed by an extension of an end portion of the connector; or the suction end is detachablely connected with the connector.

4. The electronic cigarette according to claim 3, wherein the suction end and the connector are detachablely connected via a screw thread or a rotatable snap.

5. The electronic cigarette according to claim 1, wherein at least one air inlet which communicates with the suction end and is isolated from the liquid container is provided on the electronic cigarette body.

6. The electronic cigarette according to claim 1, wherein the liquid container and the connector are detachablely connected via a screw thread or a rotatable snap;

the battery rod assembly and the first connecting part are detachablely connected via a screw thread or a rotatable snap; and the atomizing assembly and the second connecting part are detachablely connected via a screw thread or a rotatable snap.

7. The electronic cigarette according to claim 1, wherein a sealing gasket for sealing the liquid container is provided at a position where the connector connects with the liquid container.

8. The electronic cigarette according to claim 1, wherein the liquid container is a transparent container.

9. The electronic cigarette according to claim 8, wherein the liquid container is a glass bottle.

10. The electronic cigarette according to claim 8, wherein the liquid container is coated by a protective cartridge and the protective cartridge is provided with a cigarette liquid observation window.

11. An electronic cigarette, comprising;

an electronic cigarette body;

wherein the electronic cigarette body comprises a suction end, a liquid container for containing a cigarette liquid, an atomizing assembly for atomizing the cigarette liquid, and a battery rod assembly for supplying power to the atomizing assembly; and the atomizing assembly and the battery rod assembly are inserted in the liquid container, and wherein, an accommodating part for accommodating the atomizing assembly is provided in the battery rod assembly;

the atomizing assembly is arranged inside the accommodating part; and a connecting part configured to be detachablely connected with the atomizing assembly is provided at an end portion of the battery rod assembly, the end portion of the battery rod assembly being connected with the atomizing assembly; and wherein a first electrode and a second electrode for electrically connecting with atomizing electrodes of the atomizing assembly are provided in the connecting part;

the first electrode and the second electrode are electrically connected with battery electrodes of the battery rod assembly; and an insulation ring is provided between the first electrode and the second electrode.

12. The electronic cigarette according to claim 11 wherein the liquid container which accommodates the battery rod assembly is detachablely connected with the suction end; and the battery rod assembly and the suction end are detachablely connected; or the suction end is formed by an extension of an end portion of the battery rod assembly.

13. The electronic cigarette according to claim 12, wherein a sealing ring for sealing the liquid container is provided at a position where the connector connects with the liquid container.

14. The electronic cigarette according to claim 12, wherein the liquid container and the suction end are detachablely connected via a screw thread or a rotatable snap; and the battery rod assembly and the suction end are detachablely connected via a screw thread or a rotatable snap.

15. The electronic cigarette according to claim 11, wherein at least one air inlet which communicates with the suction end and is isolated from the liquid container is provided on the electronic cigarette body.

16. The electronic cigarette according to claim 11, wherein the liquid container is a transparent container; and the liquid container is coated by a protective cartridge and the protective cartridge is provided with a cigarette liquid observation window.

* * * * *